US007165635B2

(12) United States Patent
Kauffman et al.

(10) Patent No.: US 7,165,635 B2
(45) Date of Patent: Jan. 23, 2007

(54) DEFLECTION SWIVEL AND METHOD

(75) Inventors: Vernon E. Kauffman, Friendswood, TX (US); Douglass B. Leeth, Lake Charles, LA (US); John A. Lemke, Welsh, LA (US); Max H. Smith, Lake Charles, LA (US)

(73) Assignee: Specialty Rental Tool & Supply, LP, Alvin, TX (US)

( * ) Notice: Subject to any disclaimer, the term of this patent is extended or adjusted under 35 U.S.C. 154(b) by 252 days.

(21) Appl. No.: 10/708,752

(22) Filed: Mar. 23, 2004

(65) Prior Publication Data

US 2005/0211444 A1 Sep. 29, 2005

(51) Int. Cl.
*E21B 17/05* (2006.01)
*F16L 27/00* (2006.01)

(52) U.S. Cl. ..... 175/320; 166/344; 166/355; 285/261; 285/271; 285/263

(58) Field of Classification Search ..... 166/355, 166/367, 346, 384, 78.1, 344, 358, 345; 175/61, 175/92, 320, 89, 90; 403/127, 78, 164, 165; 285/261, 271, 263
See application file for complete search history.

(56) References Cited

U.S. PATENT DOCUMENTS

| | | | | | |
|---|---|---|---|---|---|
| 3,156,310 | A | * | 11/1964 | Frisby | 175/76 |
| 3,450,421 | A | * | 6/1969 | Harwell, Jr. | 285/24 |
| 3,663,043 | A | * | 5/1972 | Walton | 285/113 |
| 4,045,054 | A | * | 8/1977 | Arnold | 285/18 |
| 4,180,285 | A | * | 12/1979 | Reneau | 285/261 |
| 4,648,469 | A | * | 3/1987 | Biggs et al. | 175/7 |
| 4,732,223 | A | * | 3/1988 | Schoeffler et al. | 175/73 |
| 5,423,389 | A | * | 6/1995 | Warren et al. | 175/75 |
| 5,996,712 | A | | 12/1999 | Boyd | 175/321 |
| 6,244,345 | B1 | | 6/2001 | Helms | 166/301 |
| 6,553,825 | B1 | | 4/2003 | Boyd | 73/152.6 |

* cited by examiner

*Primary Examiner*—David Bagnell
*Assistant Examiner*—Robert E. Fuller
(74) *Attorney, Agent, or Firm*—David B. Dickinson; Lundeen & Dickinson, LLP

(57) ABSTRACT

A deflectable in-line swivel that permits axial deflection of a tubular string is presented. The in-line swivel is preferably constructed as a ball and socket design whereby the ball of a swivel mandrel is permitted to articulate within a socket of a retainer sub. The system preferably includes a thrust bearing to allow the tensile loads to be carried across the swivel.

15 Claims, 2 Drawing Sheets

DEFLECTION SWIVEL AND METHOD

BACKGROUND OF INVENTION

The present invention relates generally to an in-line swivel for use in drilling and pipeline operations. More particularly, the invention relates to an in-line swivel permitting deflection when the tubular string below the swivel is deflected by relative motion from the longitudinal axis of the remainder of the tubular string. More particularly still, the invention relates to an in-line swivel permitting deflection of a pipe string resulting from "wave action" and wind changes experienced when used in conjunction with floating drilling rigs or tankers.

The use of in-line drill string swivels in drilling applications has long been known to those in the drilling industry. Often, during sea-based drilling operations on floating platforms, the drill string suspended from a drilling mast may experience movement not generally experienced by land based drilling rigs which are fixed to the ground. These floating drill rigs may have drilling masts extending hundreds of feet above the rotary table support the drill string hanging below. If the rotary table floor rotates or rocks while the in-line swivel is supporting the drill string, damage may occur to the drill string or Kelly drive. Particularly, if a drill string on a movable platform is connected to a fixed or rigid tubular string, stress and strain will build up if a provision to allow rotation and deflection therebetween is not present. Furthermore, movement of the platform or vessel from wave action or wind (or intentional movements) can overstress and even loosen a threadably connected pipe string. Finally, in addition to "drill string" applications, other applications of pipe, either threadably connected or bolted, exist where angular and rotational deflections are an issue.

SUMMARY OF INVENTION

The present invention relates to a deflection swivel providing a tubular retainer sub, a tubular swivel mandrel having an enlarged rounded head at its upper end, and a retainer nut providing an opening larger than the outer diameter of a lower end of the tubular swivel mandrel, connected to the tubular retainer sub enclosing said rounded head of the tubular swivel mandrel to permit deflection of the swivel mandrel and enclosing a bearing having an upper surface conforming to the rounded head of the tubular swivel mandrel to thereby permit rotational movement of the mandrel upon deflection of the swivel mandrel from the longitudinal axis of the retainer sub.

The hardened wear collar inserted in the interior surface of the retainer sub provides a profile conforming to the rounded head of the tubular swivel mandrel thereby permitting the rounded head to rest within the profile, evenly distributing the strain caused by lateral movement of the mast of the drilling structure, around the collar surface. The wear collar is retained between an upper edge of the bearing and the lower hemispherical surface of the swivel mandrel to permit deflection of the swivel mandrel. Alternatively, the wear collar could be formed as the upper edge of the bearing. Each embodiment can be slipped over the lower end of the mandrel member upon makeup and positioned between the retainer sub and the bottom hemispherical surface of the swivel mandrel. The wear collar moreover could be segmented to allow portions of the wear collar to be replaced without replacement of the whole.

The bearing which supports the rotation of the mandrel can be lubricated by injection of lubricant from a lower edge of retainer nut. The bearing and its lubrication are protected from the damage that can be observed from the ingress of drilling fluid into the bearing race since the present invention provides one or more seals on the upper hemispherical surface of the swivel mandrel to prevent egress of drilling fluid around the rounded head of the mandrel into the bearing supporting the mandrel in the retainer sub.

A hardened insert can be retained in a lower radial portion of the retainer sub providing a cooperating hemispherical surface conforming to the rounded upper surface shape of the swivel mandrel or this cooperating surface may be formed on the inner surface of the enlarged lower end of the retainer sub. Since this surface can experience wear from repeated deflections of the swivel from its principal longitudinal axis, a wear surface preventing premature wearing of the retainer sub is expected to be preferred. This hardened surface would provide seals to prevent drilling fluid from flowing around the hardened insert to reach the bearing.

DETAILED DESCRIPTION

Figure 1:
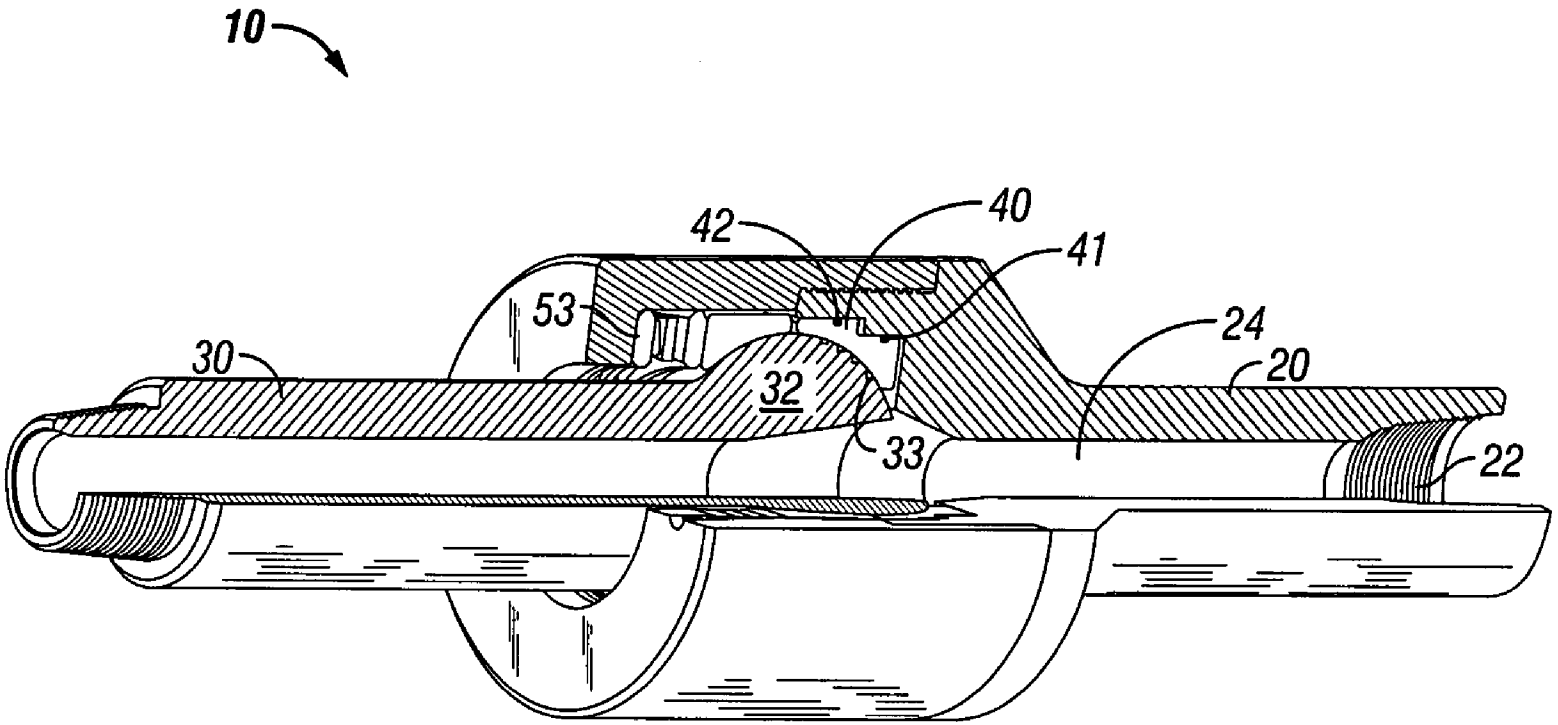
FIG. 1 is a partial sectional drawing of the deflection sub in accordance with a preferred embodiment of the present invention.
Figure 2:
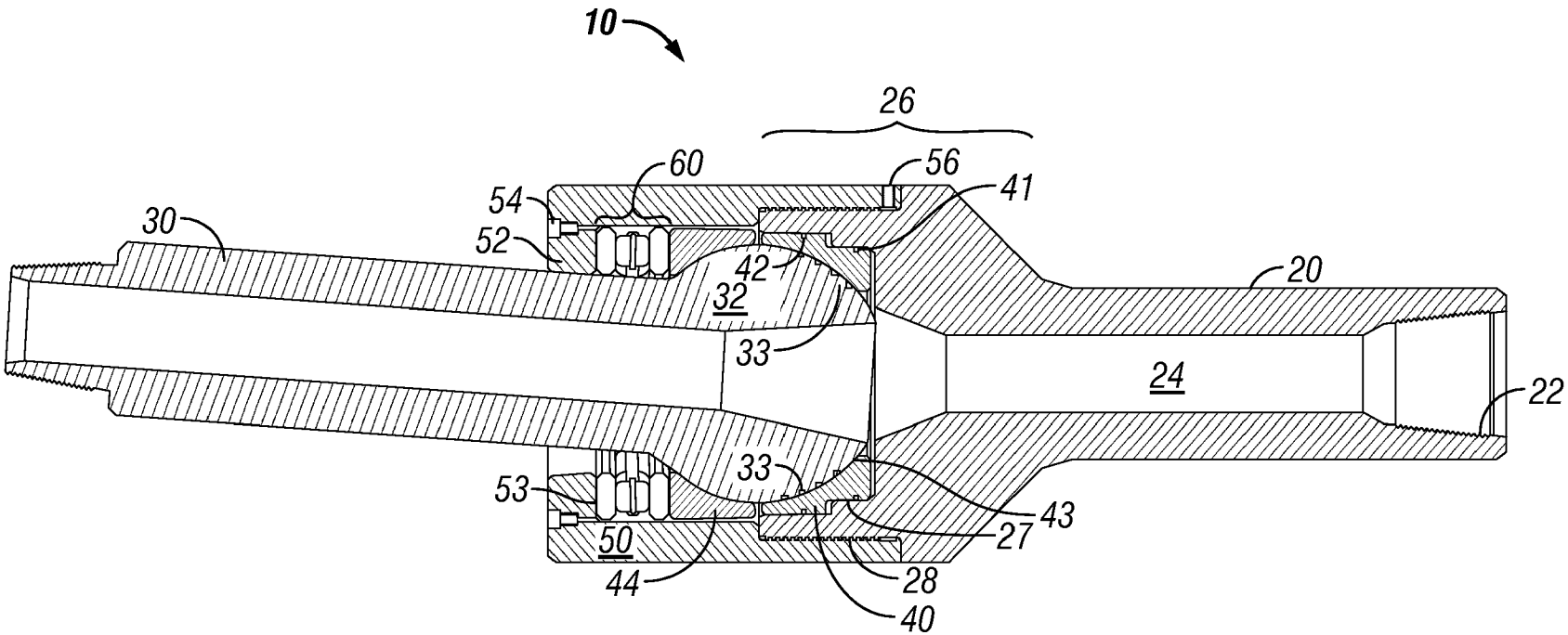
FIG. 2 is a cross-sectional drawing side view of the deflection sub of FIG. 1.

Referring to FIGS. 1 and 2 collectively, a deflection sub 10 in accordance with a preferred embodiment of the present invention is shown. Deflection sub 10 assembly preferably includes a tubular retainer sub 20, a swivel mandrel 30, a retainer nut 50, and a bearing 60. Retainer sub 20 preferably includes a rotary threaded drill connection 22 at its distal end to permit connection thereto with additional threaded pipe string components. While threaded connection 22 is shown as a female connection, it should be understood that any connection known in the art may be employed to connect retainer sub 20 to other components. Additionally, retainer sub 20 preferably includes a bore 24 therethrough to allow the flow of drilling fluids from the fluid system into the drill string. Retainer sub 20 is shown including an enlarged end 26 including threads 28 on an exterior lateral surface and a recess on its interior surface providing a seat 27 for a socket bushing 40.

Socket bushing 40 preferably includes an exterior surface mating with seat 27 and a hemispherical interior surface 43. A passage through socket bushing 40 permits drilling fluid to flow through into the throat of swivel mandrel 30 without obstruction. Socket bushing 40 can be integral to retainer sub 20. Furthermore, socket bushing 40 preferably includes exterior circumferential seals 41 and 42 to prevent the escape of fluids or the ingress of contaminants between the outer surface of socket bushing 40 and retainer sub 20. Seals 41, 42 may be designed to allow rotation of socket bushing 40 with respect to retainer sub 20, if a dynamic-type sealing arrangement is desired. Optionally, the cavity, if any, between seals 41, 42 may be filled with a generally incompressible lubricant to effectuate the integrity of the seals. While seals 41, 42 are shown schematically as o-ring type seals, it should be understood by one of ordinary skill in the art that any sealing mechanism may be employed, including metal to metal seals.

Swivel mandrel 30 is preferably constructed as a tubular member having a spherically-shaped ball end 32. Ball end 32 is preferably configured to be substantially the same contour and profile as hemispherical inner surface 43 of socket bushing 40. A plurality of sealing elements 33 are preferably located about the leading edge of ball end 32 to prevent leakage of fluid from bore 24 around the outer profile of ball end 32. As mentioned above, seals 33 are shown schematically as o-ring type seals, but any sealing scheme known to one skilled in the art may be employed, including a metal to metal design. Furthermore, seals 33 are preferably designed such that relative movement of ball end 32 with respect to socket bushing 40 is permitted without compromising the integrity of the seals.

Following the installation of socket bushing and swivel mandrel into seat 27 of retainer sub 20, a backup ring 44 is installed. Backup ring 44 is preferably designed with a semispherical profile on its leading end and a planar surface on its trailing end. With backup ring 44 securely held in place, ball end 32 of swivel mandrel 30 will be firmly held in place within retainer sub 20. Following installation of backup ring 44, a bearing assembly 60 is installed. Bearing assembly 60 is preferably constructed as a thrust bearing, one whereby axial loads of swivel mandrel 30 and retainer sub 20 are resisted without damaging components of deflection sub assembly 10. Construction of bearing assembly 60 may be of any design known by one skilled in the art but should be capable of resisting the magnitude of the axial loading expected to be experienced by deflection sub assembly 10. Bearing assembly 60 is preferably constructed to allow the rotational movement of swivel mandrel 30 and ball end 32 with respect to retainer sub 20.

Following the installation of bearing assembly 60, retainer nut 50 is installed. Retainer nut 50 is threaded onto retainer sub 20 and provides interior threads to correspond with outer threads of retainer sub 20. Retainer nut preferably includes an interior lip 52, and a pair of hydraulic ports 54. Interior lip 53 retains bearing assembly 60, backup ring 44, ball end 32, and socket bushing 40 against seat 27 of retainer sub 20. Hydraulic ports 54 may be used to either fill cavities within the space formed between retainer nut 50 and retainer sub 20 or, in the alternative, may serve to energize bearing assembly 60. With deflection sub assembly 10 completely assembled with retainer nut 50 tightly threadably secured to retainer sub, a grub screw 56 can be tightened to prevent the loosening thereof.

Numerous embodiments and alternatives thereof have been disclosed. While the above disclosure includes the best mode belief in carrying out the invention as contemplated by the named inventors, not all possible alternatives have been disclosed. For that reason, the scope and limitation of the present invention is not to be restricted to the above disclosure, but is instead to be defined and construed by the appended claims.

The invention claimed is:

1. An in-line swivel comprising:

a tubular retainer sub;

a swivel mandrel having an enlarged rounded head at its upper end;

a retainer nut providing an opening larger than an outer diameter of a lower end of the tubular swivel mandrel, connected to the tubular retainer sub enclosing said rounded head of the tubular swivel mandrel to permit deflection of the swivel mandrel and enclosing a bearing to thereby permit rotational movement of the mandrel; and a backup ring retained between an upper edge of the bearing and a lower hemispherical surface of the swivel mandrel to permit deflection of the swivel mandrel.

2. The in-line swivel of claim 1 further comprising a socket bushing inserted in an interior surface of the retainer sub providing a profile conforming to the rounded head of the tubular swivel mandrel.

3. The in-line swivel of claim 2 wherein the socket bushing is a hardened insert.

4. The in-line swivel of claim 3 wherein the hardened insert further comprises seals to prevent drilling fluid from flowing around the insert to reach the bearing.

5. The in-line swivel of claim 1 wherein the bearing is lubricated by injection of a lubricant from a lower edge of the retainer nut.

6. The in-line swivel of claim 1 further including one or more seals on an upper hemispherical surface of the swivel mandrel to prevent egress of drilling fluid around the mandrel into the bearing supporting the mandrel in the retainer sub.

7. A deflection swivel to allow the deflection of a tubular string attached thereto, the deflection swivel comprising:

a retainer sub defining a receptacle;

a socket bushing within said receptacle, said socket bushing having a substantially spherical bushing surface;

a swivel mandrel having a spherical distal end sealingly received into said spherical bushing surface;

a bearing assembly configured to resist movement of said spherical distal end away from said socket bushing;

a retainer nut configured to compress said bearing assembly, said spherical distal end, and said socket bushing within said receptacle; and a backup ring located between said bearing assembly and said spherical distal end, said backup ring having a second spherical bushing surface to engage said spherical distal end opposite said socket bushing.

8. The deflection swivel of claim 7 wherein said bearing assembly includes a thrust bearing.

9. The deflection swivel of claim 7 wherein said retainer nut includes a hydraulic port, configured to communicate with said bearing assembly.

10. The deflection swivel of claim 7 wherein the tubular string is a drill string.

11. The deflection swivel of claim 7 wherein the tubular string is a pipeline string.

12. The deflection swivel of claim 7 wherein said retainer nut limits axial deviation of said swivel mandrel with respect to said retainer sub.

13. The deflection swivel of claim 7 further comprising a plurality of seals between said socket bushing and said receptacle.

14. The deflection swivel of claim 7 wherein said retainer nut is threadably engaged upon said retainer sub.

15. A method for coupling adjacent sections of a tubular string using the in-line swivel of claim 1, the method comprising:

attaching a first end of the in-line swivel to a relatively rigid section of the tubular string;

coupling a relatively displaceable section of the tubular string to a second end of the in-line swivel; and, articulating the relatively displaceable section with respect to the relatively rigid section with the enlarged rounded head and the backup ring of the in-line swivel.

* * * * *